United States Patent [19]

van Vliet

[11] Patent Number: 4,662,562

[45] Date of Patent: May 5, 1987

[54] AIR HEATING AND VENTILATING SYSTEM

[76] Inventor: Cors van Vliet, 8 Brink, 8021 Ap Zwolle, Netherlands

[21] Appl. No.: 726,926

[22] Filed: Apr. 25, 1985

Related U.S. Application Data

[63] Continuation of Ser. No. 398,626, Jul. 15, 1982, abandoned.

[30] Foreign Application Priority Data

Jul. 17, 1981 [NL] Netherlands ..... 8103413

[51] Int. Cl.[4] ..... F24F 7/00

[52] U.S. Cl. ..... 237/46; 126/427; 237/55

[58] Field of Search ..... 126/299 D, 427; 165/901, 908; 237/46, 12.1, 55, 12.3 A; 122/20 B

[56] References Cited

U.S. PATENT DOCUMENTS

| | | | |
|---|---|---|---|
| 1,608,435 | 11/1926 | Scott | 237/46 |
| 1,877,223 | 9/1932 | Buck | 126/113 X |
| 2,130,386 | 9/1938 | Flouor | 237/12.1 |
| 2,414,828 | 1/1947 | McCollum | 237/12.1 |
| 2,734,443 | 2/1956 | Wood | 98/1.5 |
| 3,926,099 | 12/1975 | Grunenwald | 98/2.05 |
| 3,967,780 | 7/1976 | Traver | 236/49 |
| 4,127,100 | 11/1978 | Baker | 126/61 |
| 4,291,834 | 9/1981 | Palazzetti et al. | 237/12.1 |

FOREIGN PATENT DOCUMENTS

| | | | |
|---|---|---|---|
| 515564 | 2/1918 | France | 237/46 |

*Primary Examiner*—Henry Bennett

[57] ABSTRACT

An air heating and ventilation system particularly suitable for well-insulated and draught-proof dwellings or buildings, there being provided a supply duct for fresh external air, connected to a main fan, a combustion chamber with an exhaust duct for the flue gases, an air heater disposed in the combustion chamber, a main distribution duct, feed ducts with controllable terminals for the rooms, a dirty air discharge duct provided with a fan, and a heat exchanger disposed between the supply duct for the outside air and the exhaust duct for the flue gases. The dirty air discharge duct is connected to the combustion chamber, so that dirty air at least in part acts as air for combustion and the remaining part is discharged together with the flue gases via the heat exchanger, the latter being adapted for transmitting the resulting condensate to the incoming external air.

15 Claims, 4 Drawing Figures

AIR HEATING AND VENTILATING SYSTEM

This application is a continuation of application Ser. No. 398,626, filed July 15, 1982, now abandoned.

BACKGROUND OF THE INVENTION

1. Field of the Invention

This invention relates to an air heating and ventilation system for a building or dwelling, comprising a supply duct connected to a main fan for fresh external air, a combustion chamber with an exhaust duct for the flue gases, an air heater disposed in said combustion chamber, a main distribution duct, feed ducts with controllable terminals for the rooms, a dirty air discharge duct provided with a fan, heat exchanger disposed between the supply duct for fresh external air and the exhaust duct for the flue gases.

2. Description of the Prior Art

An air heating and ventilation system of this kind has been used in the art. The known systems are so-called "open systems" in which the combustion air is retracted from the room in which the installation is placed. For this reason the outside walls of the building or dwelling have to be provided with ventilation gates. Hence, the known systems are not very suitable for well-insulated and draught-proof dwellings because the ventilation gates abolish the draught-proofness of the dwelling and cause considerable heat losses.

SUMMARY OF THE INVENTION

It is a primary object of the present invention to improve an air heating and ventilation system for a building or dwelling to provide maximum possible fuel efficiency and to prevent the above drawbacks.

To this end, according to the invention, the dirty air duct is connected to the combustion chamber, and dirty air at least partly acts as air for combustion and the remaining part of the dirty air then being discharged together with the flue gases, the heat-humidity exchanger being provided with means for transmitting the resulting condensate to the incoming external air.

The dirty air discharged from the kitchen, toilets and other wet rooms generally contains a considerable quantity of heat and water vapor. The combined discharge of the flue gases and the dirty air from the ventilation system greatly increases the efficiency of the installation, since the water vapor and heat produced from the combustion of the natural gas fuel is now also used to heat and moisten the supplied fresh external air.

The resulting air humidification is self-regulating. If the external air temperature is low, the external air contains little water vapor. In that situation, however, fuel firing increases so that the flue gases contain a considerable amount of water vapor, which can be transferred to the supplied external air. If the external air temperature is high, there will be less need for firing and the reverse will apply.

By the fact that the dirty air discharged from the wet rooms is used as air for the combustion, the system according to the invention is a so-called "closed system" in which no open combustion takes place. This system is therefore highly suitable for well-insulated and draught-proof dwellings, having a fully controlled supply and discharge of the ventilation air.

According to one embodiment of the invention, the means for transmitting the condensate consists of a reservoir for collecting the condensate, the reservoir connected via a pipe and a pump to an evaporator disposed in the external air supply duct near the air heater.

According to another embodiment of the invention, the means for transmitting the resulting condensate to the incoming external air has heat exchanging surfaces of the heat exchanger formed of a moisture-absorbent material having a relatively high air-tightness.

The water vapor present in the discharged flue gases can be absorbed by the humidity-exchanging surfaces as a result of condensation by cooling, and is transmitted to the supplied external air. Of course under these conditions, it is very important that the flue gases should not themselves reach the air supply duct, so that according to the invention the static pressure in those compartments of the heat-humidity exchanger through which the flue gases flow is lower than in the compartment through which the external air flows.

According to one embodiment of the invention, the heat and humidity exchange surfaces of the heat-humidity exchanger are made of paper. Paper is commercially available in many grades and qualities and it has been found that this material is excellent for the requirements in question.

In a preferred embodiment of the invention, the main fan, the discharge fan for the dirty air, the air heater, and the heat-humidity exchanger are accommodated in one cabinet. The main advantage of this installation is that the system can be readily installed in a dwelling and the various components in the cabinet can be pre-adjusted at the factory so that installation does not require any highly skilled personnel.

The combustion chamber preferably also contains a hot-water supply. The features of the present invention which are believed to be novel are set forth with particularity in the appended claims. Other claims and many of the attendant advantages will be more readily appreciated as the same becomes better understood by reference to the following detailed description and considered in connection with the accompanying drawings in which like reference symbols designate like parts throughout the figures.

DESCRIPTION OF THE DRAWINGS

FIG. 1 is a diagram of an air-heating and ventilation system according to the invention.

DESCRIPTION OF THE PREFERRED EMBODIMENTS

Figure 2:
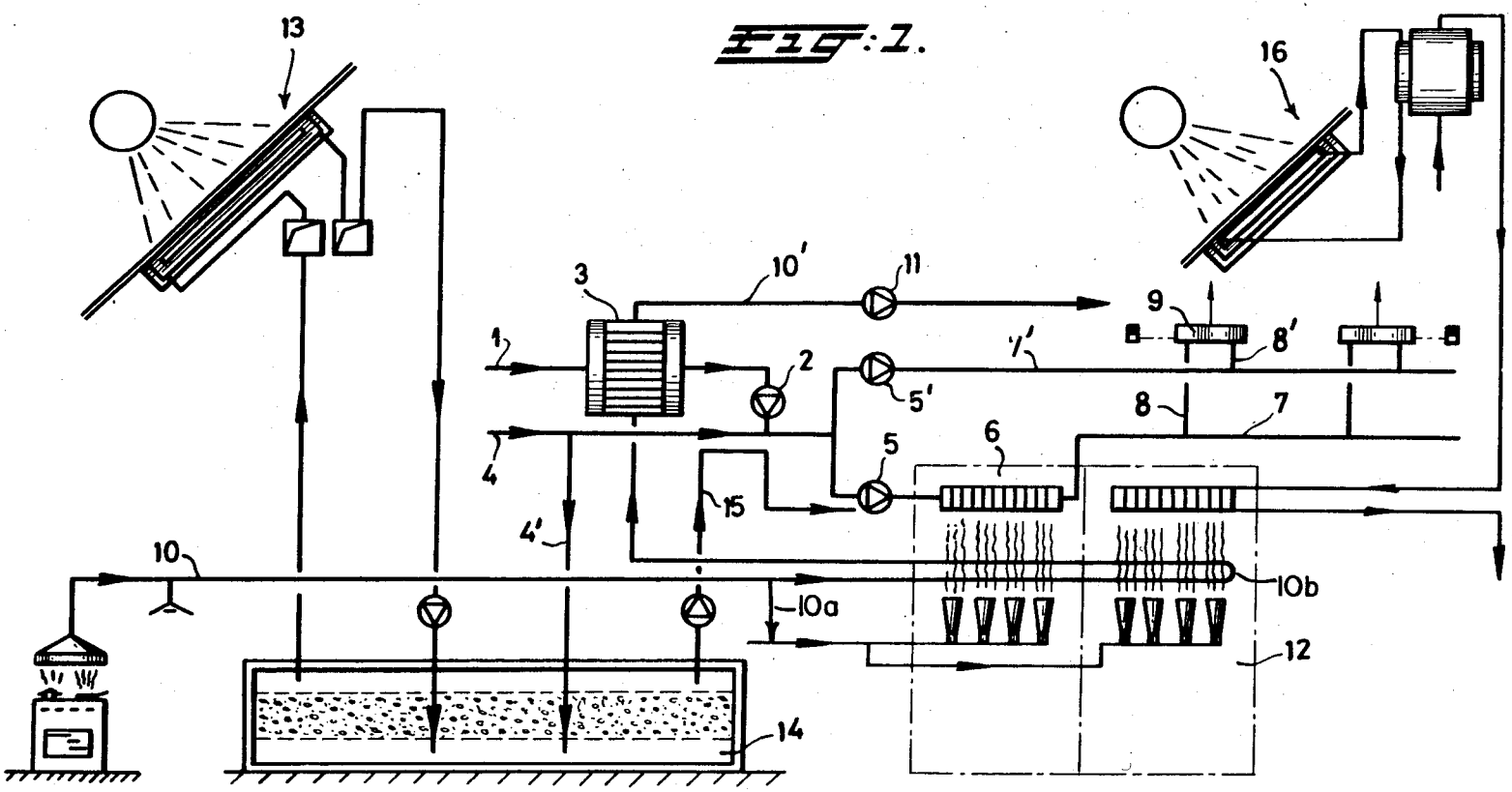
FIG. 2 is a partial section and top plan view of the cabinet containing therein the main components of the system shown in FIG. 1.
Figure 2:
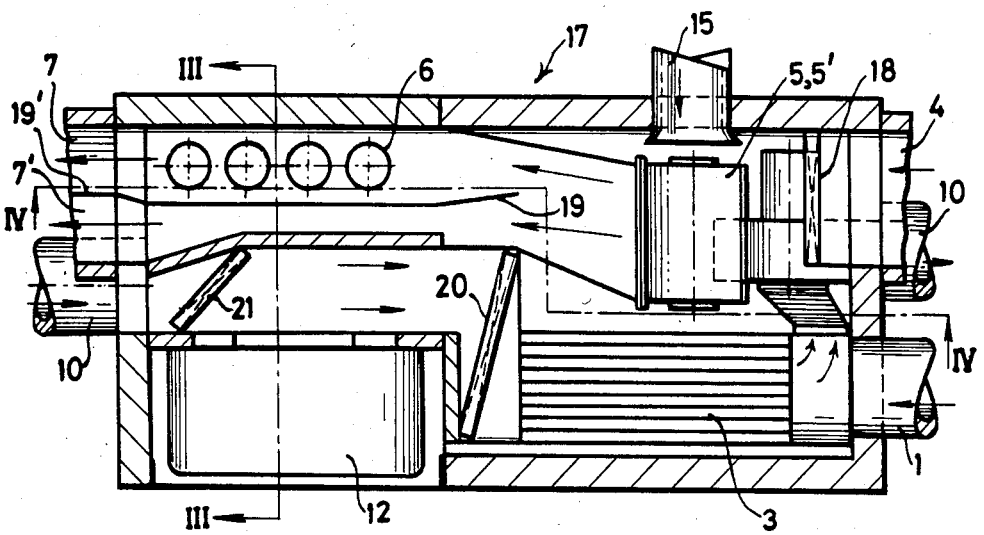

Referring now to FIG. 1 in which is a schematic illustration of an example of an air heating and ventilating system for a dwelling, the system operates on the double-duct principle, i.e. , a duct carrying heated air and a duct carrying ventilation air run to each room, the air flows being capable of being mixed to the required temperature by means of terminals or mixer units in each room. The system illustrated here is also provided with solar collectors and a hot-water supply.

External air is drawn in via duct 1 by means of a fan 2. Duct 1 contains a heat-humidity exchanger 3 which will be described hereafter. Duct 1 is then connected to a duct 4 by which return air is circulated from the rooms. The return air together with the external supply air is jointly drawn in by a main fan which is shown in split form with the references 5 and 5', although in actual fact it does consist of a single fan. This main fan delivers some of the supplied air to a duct 7 via an air heater 6, while the remainder of the supplied air is fed along the air heater directly to duct 7'. In practice, the ducts 7, 7' form part of a single main distribution duct provided with a partition for the two air flows, i.e. a cold air flow and a hot air flow. The air heater illustrated here is of the type described in the U.S. Pat. No. 3,820,526 of Applicant.

A number of feed ducts 8, 8' are connected to the main duct 7, 7' and lead to the room(s) of the building that is to be heated and ventilated. Each feed duct 8, 8' contains a mixer unit 9 provided with a damper controlled by a room thermostat, by means of which the temperature of the air fed to the room in question can be controlled.

This damper is so constructed that the amount of air fed to the room remains the same in all damper positions, in order to attain the required ventilation of the rooms. This individual room temperature regulation must be regarded as regulation downstream of the gas-fired air heater 6. The upstream regulation, i.e. the thermal capacity regulation of the air heater, takes place stepwise on the basis of the external temperature, by one or more burner sections being connected or disconnected as needed.

Dirty air from the kitchen, toilets and other wet rooms is discharged via duct 10 by means of fan 11. Duct 10 leads to the combustion chamber for the air supplied at 10*a* heater 6 and for a hot-water supply 12, in which a portion of the dirty air is used as air for combustion for the burners, whereafter the remaining dirty air is discharged together with the flue gases via the heat-humidity exchanger 3.

The system as described is also provided with a solar collector 13 with air as the heat-transporting medium, the air heated in the solar collector being fed to the main fan 5, 5' via a heat accumulator 14 formed by a gravel bed, and connected to a conduit 15. A branch 4' from the return air duct 4 carries return air to the heat accumulator 14. The systemalso contains a solar collector 16 using water as the heat-transporting medium, the solar collector being coupled to the hot-water supply 12.

Figure 3:
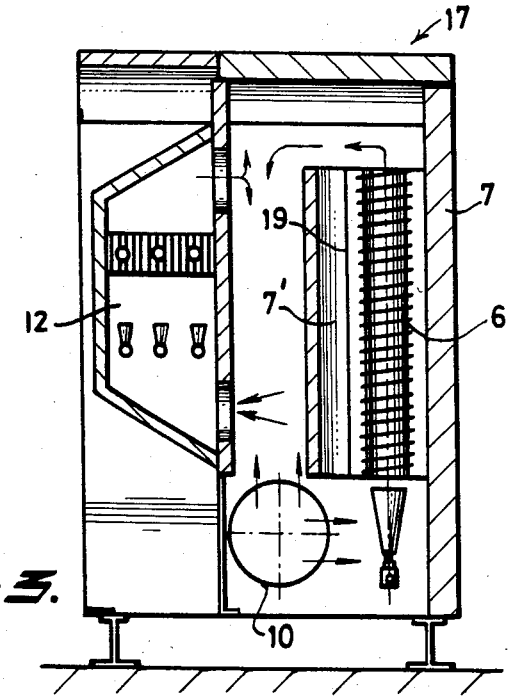
FIG. 3 is a cross-section of the cabinet taken on the line III—III in FIG. 2.
Figure 4:
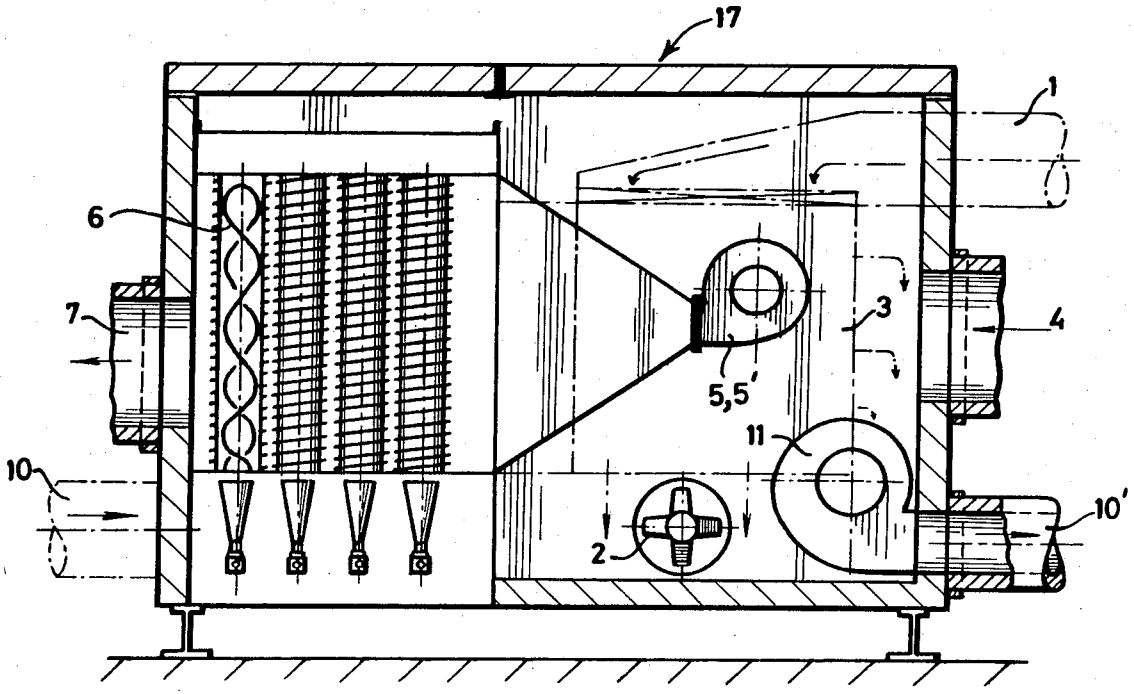
FIG. 4 is a cross-section of the cabinet on the line IV—IV in FIG. 2.

Referring now to FIGS. 2–4, a cabinet 17 contains the main components of the air heating and ventilating system, the various supply and discharge ducts being connected thereto.

As will be clear, the return air comes from the rooms through the duct 4 via a filter 18 in the intake section of the main fan 5, 5'. The external air enters the cabinet through the duct 1 and flows directly via the heat-humidity exchanger 3 to the intake section of the main fan 5, 5'. A duct 15 supplying preheated air from the heat-accumulator 14 also leads into the intake section of the main fan. After leaving the main fan, the air flow is divided into two by the partition 19, one flow being heated by the air heater 6 and leaving the cabinet via the duct 7, while the other air flow is fed along the air heater via a by-pass and leaves the cabinet via the duct 7'. The two ducts 7 and 7' form part of a common main distributing duct containing a partition 19', which is a continuation of the partition 19.

The dirty air drawn from the kitchen and wet rooms by means of the fan 11 enters the cabinet 17 via duct 10 to the combustion chamber in which the air heater 6 is disposed where it is then fed with the flue gases via a number of filters 20, 21 through the heat-humidity exchanger 3 and discharged via the duct 10'.

The combustion chamber also contains the hot-water supply 12 formed by a commercially available geyser, so that the dirty air can also serve as air for combustion for this geyser (see FIG. 3).

As will be apparent (more particularly from FIG. 2) the heat-humidity exchanger 3 is constructed as a conventional plate exchanger, the heat and humidity transferring surfaces of which are made from a suitable grade of paper.

The paper used for the exchanger must, on the one hand, have good absorption power ("blotting effect") and, on the other hand, the lowest possible air permeability. Experiments have shown that various commercially available grades of paper can be used for this purpose.

Since each cubic meter of natural gas burned produces about 1,4 litres of water vapor, it is advantageous to transfer an appreciable proportion of this water vapor to the ventilation air. To ensure that the flue gases do not pass through the paper partitions of the plate exchanger, the static pressure of the flue gases and dirty air inside the exchanger is kept lower than that of the external air. The paper partitions are also exposed to soiling so that the moisture-permeability will decrease. The paper walls are therefore combined in one package which can readily be removed and replaced at little cost.

A conventional heat exchanger provided with a reservoir for collecting the condensate can be used instead of a combined heat-humidity exchanger. The condensate can be fed to an evaporator 10*b* disposed in the supply duct near the air heater. In this way the heat of the flue gases will also cause the evaporation of the condensate in order to moisten the incoming external air.

Since the air heater, gas geyser, fans and heat-humidity exchanger are accommodated in one sheet steel cabinet, these components can be accurately adjusted relative to each other at the factory. This reduces the dependency on the skills of the installation personnel, while installation will also require considerably less time.

The main advantage, however, is that the system according to the invention provides a combined air heating and ventilating system which, by means of the heat-humidity exchanger, gives a very high efficiency for the natural gas used for firing, and there is a self-regulating humidification of the supplied external air, thus eliminating the need for extra facilities such as separate air-humidifiers. The result is a relatively small unit suitable more particularly for smaller buildings and/or dwellings with a ventilation of 200 to 300 cubic meters per hour.

Although the present invention has been shown and described in connection with a preferred embodiment thereof, it will be apparent to those skilled in the art that many variations and modifications may be made without departing from the invention in its broader aspects. It is therefore intended to have the appended claims cover all such variations and modifications as fall within the true spirit and scope of the invention.

What is claimed is:

1. An air heating and ventilation system for a building or dwelling having separate rooms, said system comprising: a supply duct connected to a main fan for supplying fresh external air, a return duct connected to said supply duct for recirculated clean air from the rooms; a combustion chamber with an exhaust duct for the flue gases; an air-heater disposed in said combustion chamber; a main air distribution duct, connected to feed ducts with controllable terminals for the separate rooms, a dirty air discharge duct provided with a fan; and a heat-humidity exchanger disposed between the external air supply duct and the exhaust duct for the flue gases, wherein the dirty air duct is connected to the combustion chamber and at least part of the dirty air acts as air for combustion, with the remaining portion of the dirty air then being discharged together with flue gases, the heat exchanger being provided with means for transmitting the resulting condensate to the incoming external air, and the clean return air is recirculated to the rooms.

2. An air heating and ventilation system according to claim 1, wherein said means for transmitting the condensate to the incoming external air comprises a reservoir for collecting the condensate, the reservoir being connected via a pipe and a pump to an evaporator disposed in the external air supply duct near the air heater.

3. An air heating and ventilation system according to claim 1, wherein said means for transmitting the resulting condensate to the incoming external air has heat exchanger surfaces formed of a moisture-absorbent material having a relatively high air-tightness.

4. An heat-humidity exchanger for use in the air heating and ventilation system of claim 3, wherein the heat and humidity transfer surfaces are formed of paper.

5. An heat-humidity exchanger according to claim 4, wherein said exchanger is constructed as a plate exchanger.

6. An heat-humidity exchanger according to claim 4, wherein the heat and humidity transfer surfaces are adapted to be removed and replaced.

7. An heat-humidity exchanger according to claim 4, wherein the static pressure in the compartment through which the dirty air and flue gases flow, is kept lower than in the compartment through which the supplied external air flows.

8. An air heating and ventilation system according to claim 1, wherein the feed ducts to the terminals are double-ducts, a first for heated air and a second for ventilation air, each terminal being provided with a damper for controlling the temperature of the air feed to the room whereby the terminal in each position of the damper is capable of delivering the same amount of air to each room.

9. An air heating and ventilation system according to claim 8, wherein the damper of each terminal is controlled by a room thermostat; the thermal capacity regulation of the air heater being controlled stepwise on the basis of external temperature by an external thermostat.

10. An air heating and ventilation system according to claim 1, wherein the main fan for the discharge of dirty air, the air heater, and the heat-humidity exchanger are accommodated in one cabinet.

11. An air heating and ventilation system according to claim 1, wherein the combustion chamber additionally contains a hot water supply.

12. An air heating and ventilation system according to claim 1, wherein said main distribution duct contains a partition for dividing the heated air flow from the ventilation air flow to the rooms.

13. An air heating and ventilation system according to claim 1, wherein a solar collector is provided connected to a heat accumulator, which supplies heated air to said accumulator and to said main distribution duct.

14. An air heating and ventilation system according to claim 1, wherein a solar collector is provided connected to a hot water supply associated with said combustion chamber.

15. An air heating and ventilation system for a building or dwelling having separate rooms, said system comprising: a supply duct connected to a main fan for supplying fresh external air to the system; a return duct connected to said supply duct for recirculated air from the rooms; a combustion chamber having an exhaust duct for the flue gases therefrom; an air heater disposed in said combustion chamber for providing heated air; a main air distribution duct having a partition therein for separating the heating air from the ventilation air and said duct arranged for supplying heated air to feed ducts with controllable terminals for the separate rooms, a dirty air discharge duct provided with an exhaust fan, and a heat-humidity exchanger disposed between said external air supply duct and said exhaust duct for the flue gases, wherein the dirty air duct is connected to the combustion chamber and at least partly provides air for the combustion, with the remaining portion, of the dirty air then being discharged together with the flue gases, and wherein the heat exchanger is provided with means for transmitting the resulting condensate from the flue gas to the incoming external air and the clean return air is recirculated to the rooms.

* * * * *